US005174747A

United States Patent [19]

Massaro, Jr. et al.

[11] Patent Number: 5,174,747

[45] Date of Patent: Dec. 29, 1992

[54] GRATE PLATE

[75] Inventors: Michael R. Massaro, Jr., Reading; Edward L. Puschock, Emmaus; Shane K. Alesi, Kutztown; Robert H. Holland, Whitehall; George W. Bryde, Kutztown, all of Pa.

[73] Assignee: Fuller Company, Bethlehem, Pa.

[21] Appl. No.: 754,448

[22] Filed: Sep. 3, 1991

[51] Int. Cl.[5] ..... F27D 15/02; F23G 5/00

[52] U.S. Cl. ..... 432/78; 110/268; 110/281; 110/289; 110/291; 126/163 R

[58] Field of Search ..... 110/289-291, 110/281, 282, 298-300; 432/78, 77; 126/163 R

[56] References Cited

U.S. PATENT DOCUMENTS

| | | | |
|---|---|---|---|
| 4,170,183 | 10/1979 | Cross | 110/291 |
| 4,473,013 | 9/1984 | John et al. | 110/291 |
| 4,510,873 | 4/1985 | Shigaki | 110/289 |
| 4,512,266 | 4/1985 | Shigaki | 110/291 |
| 4,870,913 | 10/1989 | Schneider | 110/281 |

*Primary Examiner*—Henry C. Yuen
*Attorney, Agent, or Firm*—Daniel DeJoseph

[57] ABSTRACT

The present invention pertains to a grate plate utilized in a cooling apparatus. Substantially the entire surface area of the exposed surface, that is, the surface of the grate plate that is not overlapped by a preceding grate plate, is recessed from its outside perimeter. The recessed exposed area is defined by alternating rows of (1) substantially tubular, hollow air distribution conduits that travel substantially the entire length of the recessed exposed area in a direction parallel to the movement of solid material through the cooling apparatus. The tubular air distribution conduits have two side walls and a top surface with which the solid material transported to the cooling apparatus comes into contact, and (2) narrow, open, secondary air distribution channels that also travel substantially the entire length of the recessed exposed area in a direction parallel to the movement of solid material through the cooling apparatus. The said side walls of the air distribution channels each have a plurality of air outlets or portals located thereon through which cooling air passes from the hollow interior of the air distribution channel into an adjacent secondary air distribution channel.

17 Claims, 3 Drawing Sheets

SECTION A - A

SECTION A - A

SECTION B - B

GRATE PLATE

BACKGROUND OF THE INVENTION

The invention relates in general terms to an apparatus for cooling hot material which is, for example, discharged from a kiln.

A cooling apparatus of the general class to which the invention relates is used to cool particulate material (e.g., cement clinker or other mineral materials), which has been burnt in a kiln. Such apparatus can comprise traveling grate coolers, thrust grate coolers, and the like. The hot particulate material discharged from the kiln outlet typically undergoes quenching in the material inlet part of the cooling apparatus and is then moved, distributed as well as possible, to consecutive rows of grates on which additional cooling is then carried out while the material to be cooled is transported along a path extending from the material inlet to the material outlet of the cooler on said grates. Typically, the cooling air which is blown through the hot material in the recuperation zone of the cooling apparatus is then reused or recycled further generally as air for combustion in the preceding kiln.

Grates for cooling or combustion are generally equipped with overlapping rows of grate plates, of which some are mounted in a fixed position and others are reciprocating, which generally means that they oscillate in a longitudinal direction, with the forward stroke of the oscillation being the direction in which the particulate material to be cooled travels through the cooler, and they thereby serve in part to facilitate the movement of the material through the cooler. The grate plates are mounted on a carrier beam which is transverse to the direction of material flow through the cooler, with adjoining grate plates abutting. The air needed for cooling or combustion is introduced from below the grate plates through port like openings to enter, penetrate and pass through the bed of material to be cooled or burned, with said material lying on top of the grate plate.

The grate plates are subject to wear through mechanical and thermal effects. In the case of cooling grates for instance, the exposed area of the grate, which lies closer to the discharge end of the cooler, is subject to considerable abrasive wear and thermal exposure, whereas the rear, unexposed, part of the grate plate is subject to less wear, and only minimal thermal exposure.

Grate plates are provided in numerous configurations. One popular configuration is the so-called flat grate plate style, which, as its name implies, employs a flat surface on which the clinker is supported as it is transported through the cooler. In this style, ports through which cooling air passes are located on the surface of the grate. Clinker will therefore rest directly on top of the ports. There will always exist the possibility that clinker will sift through the ports, clog the air passageways and at times fall on the underlying supporting structure, causing possible damage to the supporting structure and, at times, an uneven distribution of cooling air flow resulting in a grate plate system having hot areas which can exceed metal endurance limits.

Over the years, there have been notable variations in style from the so-called flat grate configuration. One such variation, for example, is the wedge grate style in which the front area, which comprises part of the exposed area of the grate, is bent or inclined upward at an angle relative to the flat, horizontal plane of the remaining area of the grate. This design provided a partially defined area, at the point of the bend, in which the clinker could rest on the surface of the grate. This design also served to slow the flow of clinker through the cooler, which ultimately was somewhat successful in retarding red river conditions within the cooler. Air typically was distributed into the clinker through openings located in the upwardly inclined area of the grate plate. This design did not contain any anti-sifting features, as smaller particles of hot clinker could enter and clog the air distribution holes or pass through the holes into the air distribution compartments below the grate. In addition, there was only a limited tendency for the clinker to remain static within this particular design of grate. This design was utilized primarily in the mid 1950's through the 1960's.

With regard to another design of grate plate, in the early 1950's the assignee of the present invention designed and sold a particular design of a grate plate popularly known as a "pan" grate plate which in essence comprised a grate plate having on its upper surface a large depression in which clinker could be retained. The primary purpose was to retain the majority of clinker material located within the depression in a basic static condition, which thereby resulted in improved grate plate life through a reduction in wear and better resistance to red river thermal shock conditions. The grate plate could be utilized in a reciprocating or a stationary mode.

In cross-section, this prior art grate plate had a pan-like configuration, resulting in its popular name, with differing degrees of depressions with the deepest depression located in the rear of the grate plate in the unexposed area of the grate plate. The term "unexposed area", refers to that area on the upper surface of the grate plate that is, at least some of the time, covered by the overlap of a preceding grate plate. The depression was not as deep toward the front of the grate plate, that is, the portion of the grate closer to the material outlet of the cooler.

Air was distributed directly into the depression in which the clinker was held in a static condition through a plurality of air distribution holes located in the exposed, shallow portion of the grate plate. In this design, some of the clinker in the shallow area would come to rest directly on top of the air distribution holes which would potentially result in some clinker sifting into the air distribution holes, particularly during cooler fan shut down conditions.

This prior art design did not have any anti-sifting features, had high discharge velocities of air through the air distribution holes into the clinker, and, in the version sold, consisted of a single grate extending across the entire active width of the cooler which therefore necessitated replacing the entire grate in the event of excessive wear in only one area of the grate, resulting in expensive and cumbersome maintenance.

SUMMARY OF THE INVENTION

The present invention relates to a grate plate for transporting particulate and solid material in a predetermined direction through a cooling apparatus. The invention is particularly useful in the cooling of cement clinker after it exits a kiln. The cooling apparatus in which the grate plate is employed is comprised of a material inlet, a material outlet, and a plurality of rows of grate plates, which typically alternate between being stationary or reciprocating. Each row of grate plates extends across the width of the cooler in a direction transverse to the material flow through the cooler. Each preceding row of plates overlaps the following row of plates. The under surface of each grate plate is attached to a carrier beam. The upper surface of the grate plate is divided between an exposed area, which is never overlapped by any portion of a preceding grate and is located on the front portion of the grate plate, that is the portion which is closer to the material outlet end of the cooler, and an unexposed area, which is overlapped at least part of the time by a preceding grate. The grate plate of the present invention is suitable for receiving a controlled supply of air.

In the grate plate of the present invention, substantially the entire surface area of the exposed surface is recessed from both the upper edges of its outside perimeter and the surface of the unexposed area, which is substantially level. The recessed area is generally configurated to receive particulate material that is being cooled. Preferably, the majority of material residing within the recessed area will be in a static condition. The topography of the recessed exposed area is defined by alternating rows of air distributions conduits and secondary air distribution channels. Specifically, there is at least one, and preferably a plurality of substantially tubular, hollow air distribution conduits that travel substantially the entire distance of the recessed exposed area in a direction substantially parallel to the movement of material through the cooling apparatus. The conduits are in connection with a source of cooling air. The tubular air distribution conduits have a top surface and two sides upon which some of the material transported through the cooling apparatus comes into contact. Cooling air will enter the air distribution conduit from the under side of the grate plate, will travel along the length of the conduit and will exit the conduit into the secondary air channel via a plurality of air portals or outlets that are located on the side walls of the air distribution conduits after which it is directed through material that is retained within the recessed area and/or through material that is being transported through the cooling apparatus by the grate plate. The air distribution conduit is adjacent on one or more of its longitudinal sides, depending upon whether it is located at the side or toward the center of the grate plate to a narrow, open, secondary air distribution channel that travels substantially the entire distance of the recessed exposed area in a direction parallel to the movement of material through the cooling apparatus. The secondary air distribution channels are either located between two adjacent air distribution conduits or between an air distribution conduit and a inner side wall of the exposed area of the grate plate. The alternating placement of air distribution conduits and secondary air distribution channels serves to create a ridged effect over the recessed exposed area. The recessed exposed area is bordered by the front inner side wall of the grate plate, that is, the side wall opposite the front pusher face, the side inner walls of the exposed area of the grate plate and the adjacent side of the unexposed area running parallel to the front pusher face.

One of the advantages of the design of the cooling air distribution system of the grate plate of the present invention is that there is achieved a reduction, compared to a traditional grate plate design, of the velocity of the cooling air as it is both initially discharged from the air distribution outlets and as it travels through the area where the retained clinker rests. This decrease in velocity presents a number of advantages, including: (1) enhanced heat recuperation, (2) higher secondary air temperatures, (3) not promoting a fluidized condition of the clinker during normal and red river states, (4) a greater retention factor of cooling air within the retained clinker mass, (5) less abrasive characteristics to the grate which result from high velocity entrained articles abrading the air outlets and the surrounding grate plate surface and (6) improved quenching, to name a few. The actual air velocity realized is directly influenced in part by the configuration of the primary cooling air outlets which direct the discharge of cooling air into the secondary air channels and the configuration of such secondary air channels, both of which are further described below. It is anticipated that, in the preferred embodiments described below, the velocity of the cooling air will be optimized to thereby utilize the minimum velocity of cooling air needed to adequately cool the material while promoting the desired anti-sifting and anti-fluidization features. It is understood, in this regard, that the ultimate velocity of the air through the secondary air channel is also a function of factors other than the design of the primary air outlet and the secondary air channel, one factor being the packing factor of any material that may come to reside within the secondary air channel. Another advantage of the design of the present invention is that the recessed area of the exposed area will essentially accommodate the material in a static condition. The reduction of movement of material relative to the exposed metal surface area of the grate plate will significantly reduce the wear in said section.

DESCRIPTION OF THE INVENTION

Figure 1:
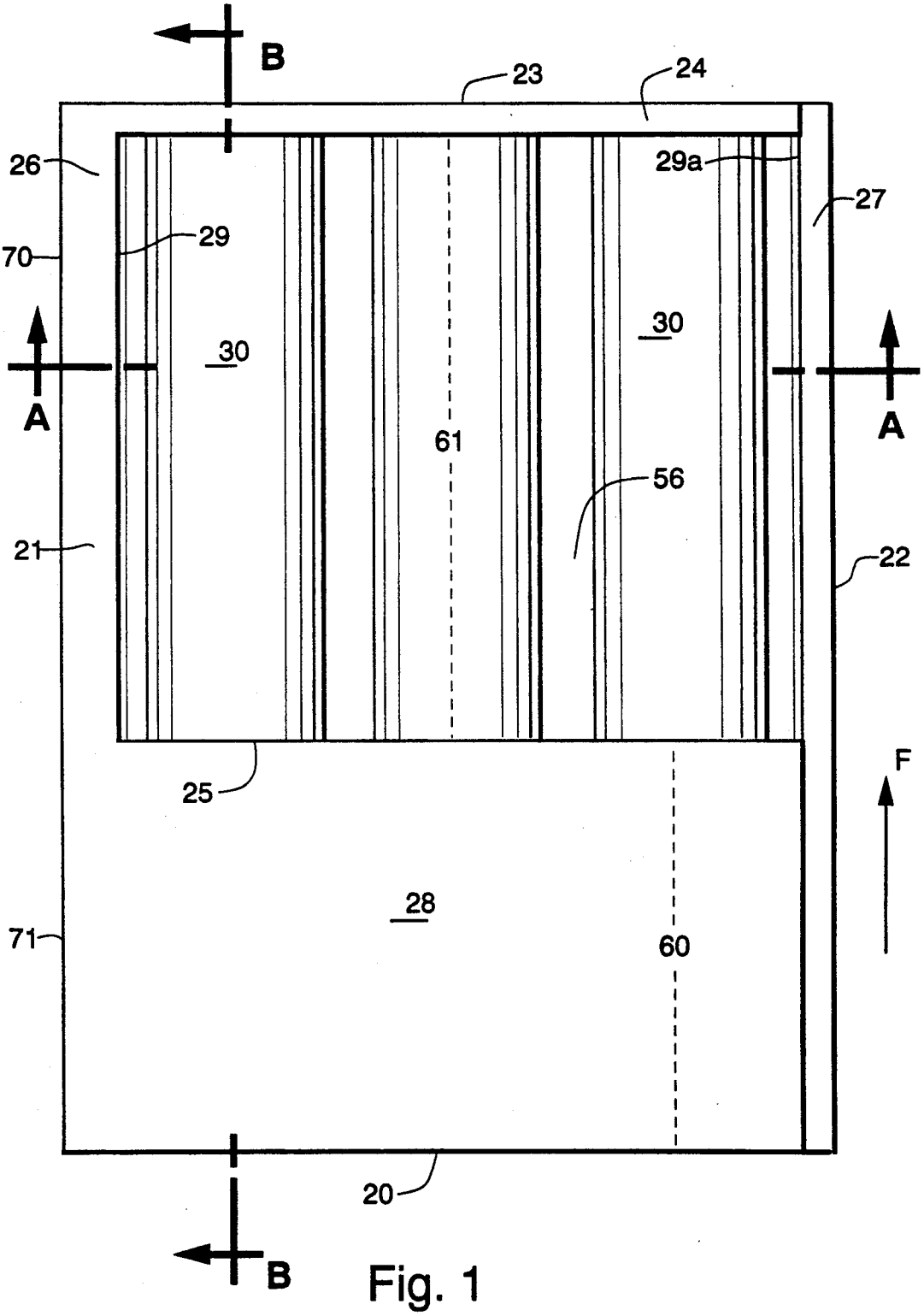
FIG. 1 depicts a top view of one of the preferred embodiments of the present invention.
Figure 2:
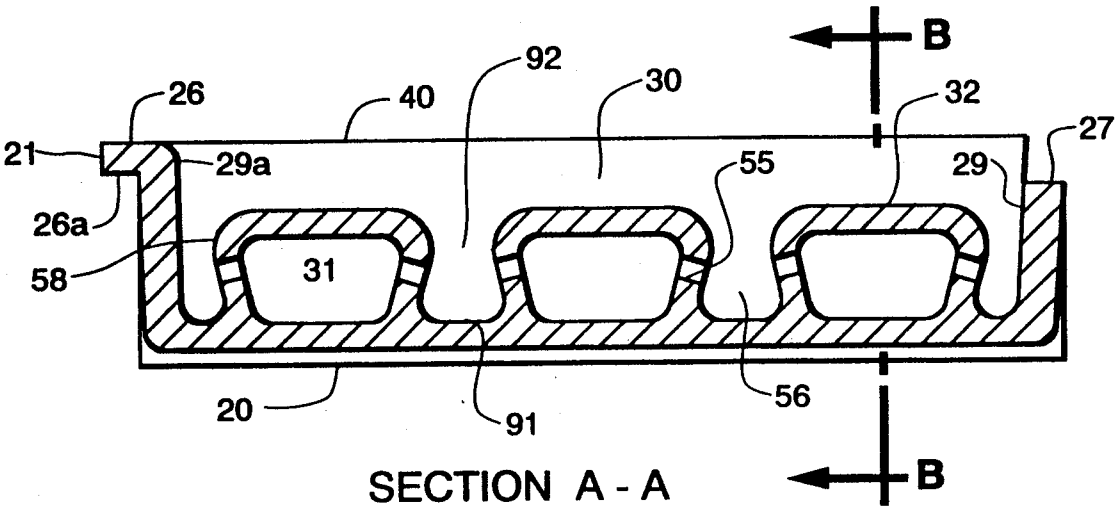
FIG. 2 depicts a section view of the embodiment depicted in FIG. 1, which is taken along axis A—A of FIG. 1.
Figure 3:
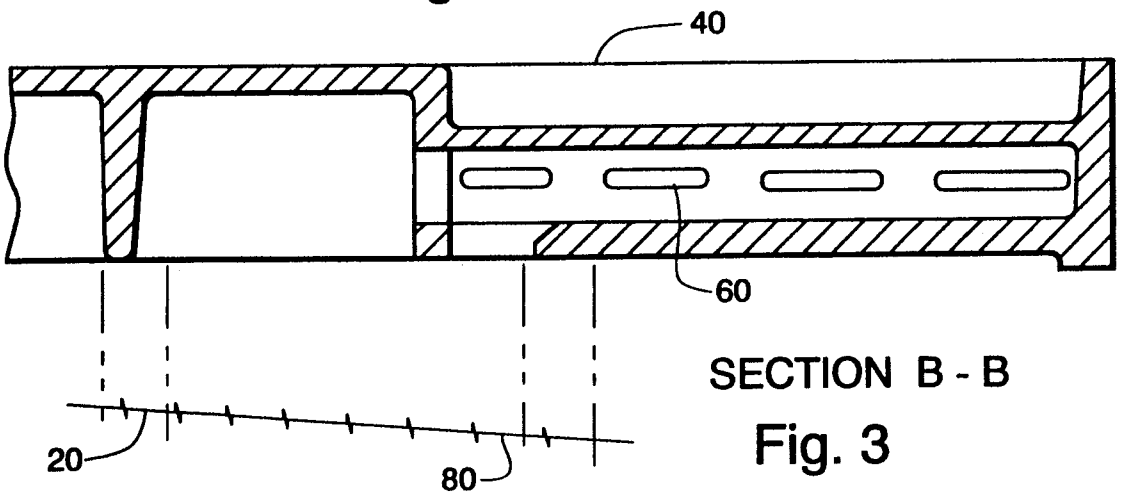
FIG. 3 depicts another section view of the embodiment depicted in FIG. 1 taken along axis B—B of FIG. 2.

Referring to FIGS. 1, 2 and 3, there is depicted one embodiment of the grate plate of the present invention generally referred to by the numeral 20, which can be utilized in a stationary or reciprocating mode.

The view of grate plate 20 as set forth in FIG. 1 is of its upper surface, which upper surface is divided into an exposed area generally referred to as 70, the longitudinal boundaries of which are as defined by the dotted line 61, and an unexposed area 71 as defined by lines 60. Material will travel through the cooler longitudinally in the direction represented by arrow F. The boundaries of the exposed area are further defined by outer side walls 21 and 22 and front pusher face 23, which has a top edge 24, and edge 25 of the unexposed area.

A significant portion of the exposed area is recessed, with said recession measured from top edge 24 of front pusher face 23, top longitudinal edges 26 and 27 and from surface 28 of the unexposed area.

As material moves through the cooler it will generally fall onto the exposed area. Surface 28 of the unexposed area will be covered during the operation of the cooler at least part of the time by an overlap created by the grate plate immediately behind it in the cooler, keeping in mind that said preceding grate plate can be either stationary or reciprocating.

The recession of the exposed area of the grate plate can be better appreciated with reference to line 40 in FIGS. 2 and 3, which represents the plane which intersects the highest points located on the upper surface of grate plate 20, which, in the case of the embodiment depicted in FIGS. 1-3 is on the same plane with top longitudinal edge 26, surface 28 of the unexposed area, and top edge 24, the latter two elements not being depicted in FIG. 2.

There is located on the exposed area 70, at least one, and preferably a plurality of air conduits 30, through which cooling air travels. Cooling air is provided to air conduits 30 primarily from carrier beam 80 that is located beneath the grate plate 20. Cooling air can enter air conduits 30 horizontally from the under portion of the grate plate near the junction point of the exposed and unexposed areas. Cooling air can also enter air conduits 30 in a vertical fashion. Air conduits 30 are essentially hollow tubular structures containing air passageway 31. Conduits 30 will run essentially the entire horizontal length, which direction is parallel to the flow of material through the cooler, of the exposed area. Cooling air will travel through the air conduits 30 lengthwise in passageway 31 in the same direction as material flow, that is, from rear to front. Cooling air is discharged from the air conduit 30 through primary air outlets 55 into secondary air channels 56, which, like conduits 30, run substantially the entire length of the exposed area, and alternate with conduits 30 to fill substantially the entire recessed area. With reference to FIG. 2, the secondary air channels 56 can be either located, between two adjacent air conduits 30 or between an inner longitudinal edge 29 or **29*a* of grate plate 20** and an adjacent air conduit.

Air conduits 30 can either be separated from an inner side wall of the longitudinal edge of exposed area by a secondary air distribution channel as is depicted in FIG. 2 or, in certain embodiments, they may be located flush with said inner side wall.

Air passing through primary air outlet 55 will be directed into secondary air channel 56. Preferably the air is directed at a downward angle, that is, an angle somewhat below the horizontal, into said secondary air distribution channel 56. The configuration of the secondary air channel 56 will of course be determined by the shape of at least one of the side walls 58 of the adjacent air distribution conduits 30. On a preferred embodiment of the invention, these side walls 58 are preferably sloped inwardly in order to shield the primary air outlet 55 from direct exposure to material, and, in such a case, the base 91 of secondary air distribution channel will be wider than upper area 92. The inwardly slope of the side walls 58, in conjunction with the downward angle of primary air outlet 55, are responsible for the essentially sift-free condition of grate plate 20. In addition, by upper area 92 being narrower than base 91, air will be better distributed through the entire length of secondary air channel 56 as cooling air will thereby be more restricted from being discharged from the top of channel 56. In addition, such better air distribution is also the result of there being an enlarged storage and transport area below the restricted upper portion. As a result, cooling air will migrate up and down the channel as required in order to maintain a uniform air flow at the top of the secondary air channel.

The primary air outlets 55 appear, on the side walls 58 of air distribution conduits 30, preferably as rectangularly shaped slots 60 with the longer sides of the slots being substantially parallel to the direction of flow of material through the cooler. The slots are preferably located approximately in the mid section, that is, about halfway up side walls 58. Since slots 60 are positioned on the side walls 58 of air distribution conduits 30, air is initially discharged from the primary air outlet 55 in a direction transverse to the clinker flow through the cooler. Rather than there being one slot in each sidewall that runs the length of the air distribution conduit, there is a plurality of slots positioned along the length of each side wall 58. It has been found that this configuration has a number of advantages. For instance, the structural integrity of the grate plate is enhanced. The slots maintain a transport velocity which will minimize the backflush of material into the air conduit. Furthermore, by minimizing the discharge velocity the potential for fluidization will be reduced. FIG. 3 shows a preferred embodiment of the placement of slots 60.

FIG. 3 also depicts an embodiment wherein slots that are located closer to the pusher face of the grate plate are longer than slots further away. As a result, there is an even distribution of air throughout the entire exposed area of the grate plate. In another embodiment of the invention, the width of the slots may vary.

A particularly advantageous feature of this invention is the inclusion of a secondary air discharge channel 56 immediately adjoining and in fluid communication with the primary air outlet 55. As indicated, there are a plurality of secondary channel that essentially run parallel to the directly of material flow across virtually the entire length of the exposed area of the grate plate. The secondary air channels function as nozzles and serve to reduce the velocity of the cooling air discharged into the clinker retention area thereby reducing the possibility of fluidization of the clinker.

Air conduits 30 will generally be wider than secondary air channels 56. In this regard, it has been determined that a preferred configuration for the secondary air channels is when their length to width ratio ranges from about 8:1 to about 30:1 and more preferably from about 10:1 to about 26:1. If the secondary air channels have a length to width ratio greater than 30:1, the velocity of the air passing through these channels will be too high. If the ratio is less than 8:1, the performance of the secondary air channel may be adversely affected and will not function as a nozzle.

When there are a plurality of air conduits or secondary air channels within a given grate plate one or more may optionally have variable widths and/or heights from a corresponding conduit or channel. In particular, air conduits and secondary channels that are located against the side edge of the grate plate will generally be narrower than their counterparts located in middle areas of the grate. In another embodiment, all of the secondary air channels may be of the same height and/or width and/or all of the air conduits may be of the same height and/or width.

The top surface 32 of each of the air conduits 30 are preferably recessed from the plane depicted by line 40, preferably in a sufficient amount so that at least some, but preferably a majority, of the clinker within the recessed area will remain in a static condition.

In the embodiment depicted in FIG. 2, side edge 27 is recessed from surface 40 to such an extent so that edge 21 of an adjoining grate plate will overlap therewith so that bottom edge 26*a* will mate with edge 27 to create an overlapping joint to thereby virtually eliminate clinker from falling between adjacent grate plates. Alternatively, the longitudinal edges of the grate plate can be identical in height and shape to each other so that adjoining grate plates would abut rather than overlap.

Figure 4:
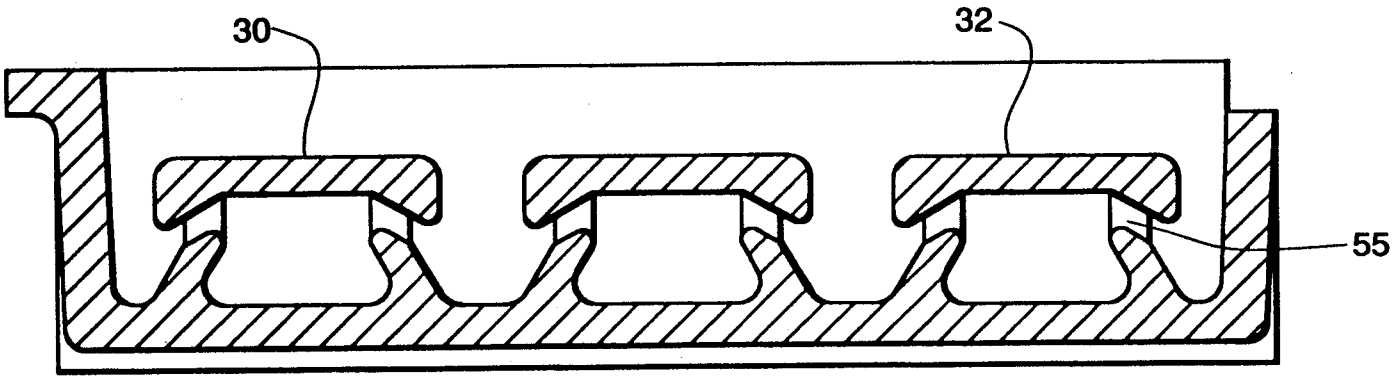
FIG. 4 depicts a section view of another embodiment of the present invention.

FIG. 4 displays another embodiment of the present invention wherein top surface 32 of the air conduit 30 overhangs, in a shroud like manner, primary air outlets 55 to thereby promote the anti-sifting features of the present invention.

Figure 5:
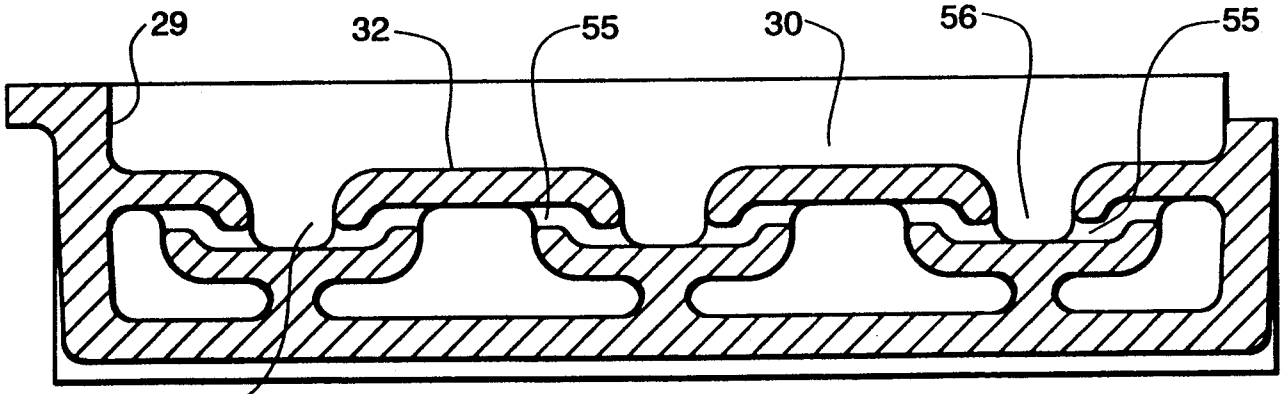
FIG. 5 depicts a section view of a third embodiment of the present invention. Like numerals in all drawings refer to like elements.

FIG. 5 presents yet another embodiment of the present invention. This embodiment differs from the embodiments of FIGS. 1–4 in several ways. First, FIG. 5 depicts an air conduit 30 being located directly against inner side wall 29, in contrast to the embodiments depicted in FIGS. 1–4 wherein the air channels are displaced from the side wall by a secondary air conduit. Furthermore, ar from primary air outlet 55 enters the secondary air channel 56 horizontally at the base 91 of the secondary air channel, rather than entering at the general mid section of the secondary air conduit in a downwardly direction, as is the case in the embodiment depicted in FIG. 2. Finally, in the embodiment depicted in FIG. 5, the shroud-like top surface 32 overhangs the primary air outlet 55

The grate plates of the present invention may be modified in such a manner as known to those skilled to be utilized in any row of the cooler without changing the unique features thereof.

We claim:

1. A grate plate for transporting particulate material in a predetermined direction through a cooling apparatus that has a material inlet, a material outlet, and a plurality of rows of grate plates, with each preceding row of plates overlapping a portion of the following row of plates, said grate plate having an outer edge, an upper surface and under surface which is attached to a carrier beam, said upper surface being divided between an exposed area which is never overlapped, and a non-exposed area which is overlapped at least part of the time by a preceding grate, wherein:

substantially the entire exposed area is recessed from the upper surface of its outer edges in order to accommodate a volume of particulate material therein and wherein further said recessed exposed area is defined by alternating rows of (a) substantially tubular, hollow air distribution conduits that travel substantially the entire distance of said recessed exposed area in a direction parallel to the movement of material through the cooling apparatus, said tubular air distribution conduits having a top surface with which some particulate material being transported through the cooling apparatus comes into contact, and two side walls and (b) narrow, open, secondary air distribution channels that travel substantially the entire distance of said recessed exposed area in a direction parallel to the movement of particulate material through the cooling apparatus; wherein said side walls of said air distribution conduit each have a plurality of primary air outlet located thereon through which cooling air passes from the interior of the air distribution conduit through a primary air outlet into an adjacent secondary air distribution channel.

2. The grate plate of claim 1 wherein at least some of the primary air outlets are in the form of rectangular slots on the side walls of the air conduit, said slots having their longitudinal side parallel to the direction the material moves through the cooler.

3. The grate plate of claim 2 wherein the slots are located approximately in the mid-section of the side walls.

4. The grate plate of claim 2 wherein the slots farther from the material inlet of the cooling apparatus are longer than those closer to the material inlet.

5. The grate plate of claim 1 wherein the cooling air passes through the primary air outlet in a downward direction into the adjacent secondary air distribution channel.

6. The grate plate of claim 1 wherein the cooling air enters the adjacent secondary air distribution channel at the base thereof.

7. The grate plate of claim wherein there is a plurality of air distribution conduits having varying widths.

8. The grate plate of claim wherein there is a plurality of air distribution conduits of varying heights.

9. The grate plate of claim 1 wherein the ratio of the length and width of the secondary air distribution conduit ranges from about 8:1 to about 30:1.

10. The grate plate of claim 1 wherein the air conduits are separated from the longitudinal side walls of the exposed area by a secondary air distribution channel.

11. The grate plate of claim 1 having at least one air conduit that is located against the longitudinal side walls of the exposed area.

12. The grate plate of claim 1 wherein the side walls of the air conduits are sloped inwardly.

13. The grate plate of claim 1 wherein the top surface of the secondary air conduit overhangs the primary air distribution outlet.

14. The grate plate of claim 1 wherein substantially all the material that resides within the exposed area is in a static condition.

15. The grate plate of claim 1 wherein the longitudinal edges of adjoining grate plates in a row are fitted to overlap with one another.

16. The grate plate of claim 1 wherein the material is cement clinker.

17. A grate plate for transporting particulate material in a predetermined direction through a cooling apparatus that has a material inlet, a material outlet, and a plurality of rows of grate plates, with each preceding row of plates overlapping a portion of the following row of plates, said grate plate having an outer edge, an upper surface and an under surface which is attached to a grate support, said upper surface being divided between an exposed area which is never overlapped, and a non-exposed area which is overlapped at least part of the time by a preceding grate, wherein the longitudinal edges of adjoining grate plates in a row are fitted to overlap with one another, wherein:

substantially the entire exposed surface is recessed from the upper surface of its outer edges in order to accommodate a volume of particulate material therein in a substantially static condition and wherein further said recessed exposed area is defined by alternating rows of (a) a plurality of substantially tubular, hollow air distribution conduits that travel substantially the entire distance of said recessed exposed area in a direction parallel to the movement of particulate material through the cooling apparatus, said tubular air distribution conduits having a top surface with which some particulate material being transported through the cooling apparatus comes into contact, and two inwardly sloped side walls and (b) a plurality of narrow, open, secondary air distribution channels that travel substantially the entire distance of said recessed exposed area in a direction parallel to the movement of particulate material through the cooling apparatus; wherein said side walls of said air distribution conduit each having a plurality of primary air outlets located thereon through which cooling air passes in a downward direction from the interior of the air distribution conduit through a primary air outlet into an adjacent secondary air distribution channel; wherein at least some of the primary air outlets are in the form of rectangular slots on the side walls of the air conduit, said slots having their longitudinal side parallel to the direction the material moves through the cooler.

* * * * *